US007070021B1

(12) United States Patent
McKinney

(10) Patent No.: US 7,070,021 B1
(45) Date of Patent: Jul. 4, 2006

(54) RACK STEP TOOL

(76) Inventor: Steven L. McKinney, 9724 Rhythm Rd., Midwest City, OK (US) 73130

( * ) Notice: Subject to any disclaimer, the term of this patent is extended or adjusted under 35 U.S.C. 154(b) by 0 days.

(21) Appl. No.: 10/754,080

(22) Filed: Jan. 8, 2004

Related U.S. Application Data

(60) Provisional application No. 60/439,773, filed on Jan. 10, 2003.

(51) Int. Cl.
*E06C 9/00* (2006.01)

(52) U.S. Cl. ..... 182/92

(58) Field of Classification Search ..... 182/90, 182/92; 248/221.12, 220.42, 220.22, 239
See application file for complete search history.

(56) References Cited

U.S. PATENT DOCUMENTS

| | | | | |
|---|---|---|---|---|
| 3,303,937 | A | 2/1967 | McConnell | |
| 3,489,382 | A * | 1/1970 | Larson | 248/220.42 |
| 3,897,926 | A * | 8/1975 | Silver | 248/220.22 |
| 3,902,568 | A * | 9/1975 | Erickson | 182/92 |
| 4,113,110 | A | 9/1978 | Mittag | |
| 4,249,635 | A | 2/1981 | West | |
| 4,405,141 | A | 9/1983 | Jurek | |
| 4,450,936 | A | 5/1984 | Strom | |
| 4,549,665 | A | 10/1985 | Smitley | |
| 4,783,034 | A * | 11/1988 | Ostrander et al. | 248/221.12 |
| 4,932,497 | A | 6/1990 | Raso | |
| 5,244,058 | A | 9/1993 | Carlson et al. | |
| 5,463,966 | A | 11/1995 | Nilsson | |
| 5,713,476 | A | 2/1998 | Highsmith et al. | |
| 5,732,793 | A * | 3/1998 | Dech | 182/187 |
| 5,845,743 | A | 12/1998 | Dechant | |
| 5,857,542 | A | 1/1999 | Mason | |
| 5,871,187 | A * | 2/1999 | Pihlaja et al. | 248/220.42 |
| D409,887 | S | 5/1999 | Mason | |
| 6,247,553 | B1 | 6/2001 | Jones | |
| 6,269,906 | B1 | 8/2001 | Dockter et al. | |
| 6,302,618 | B1 | 10/2001 | Takahashi | |
| 6,367,754 | B1 | 4/2002 | Cinker | |
| 6,378,822 | B1 | 4/2002 | Franks | |
| 6,394,228 | B1 | 5/2002 | Stephens et al. | |
| 6,439,343 | B1 | 8/2002 | Jorges et al. | |
| 6,484,981 | B1 | 11/2002 | Perrault | |
| 6,484,982 | B1 | 11/2002 | Barry et al. | |
| 6,491,272 | B1 | 12/2002 | Franks | |
| 2004/0035637 | A1* | 2/2004 | Skipper | 182/92 |
| 2004/0129496 | A1* | 7/2004 | Clark | 182/92 |

* cited by examiner

*Primary Examiner*—Alvin Chin-Shue
(74) *Attorney, Agent, or Firm*—Dunlap, Codding & Rogers, P.C.

(57) ABSTRACT

A rack step tool for use, for example, in a warehouse which houses a plurality of storage racks which support equipment, merchandise, or other items which are stored on the shelves of the storage racks and from which the equipment, merchandise, or other items are periodically removed. The rack step tool generally includes a step member which is attached to a base plate. A pair of lugs is attached to the base plate for insertion into openings in a vertical support member of the storage rack. The rack step tool can be attached to the vertical support member at various heights and can be readily disengaged therefrom. The rack step tool may further have a securing element such as a hook for insertion into another hole in the support member for further securing the rack step tool thereto.

9 Claims, 8 Drawing Sheets

RACK STEP TOOL

CROSS-REFERENCE TO RELATED APPLICATIONS

The present application claims the benefit of the priority date of U.S. Provisional Application No. 60/439,773, filed Jan. 10, 2003, the entirety of which is hereby expressly incorporated by reference herein in its entirety.

BACKGROUND

The present invention relates to devices which can be attached to and removed from a storage rack for enabling a user to step up and ascend a portion of the storage rack.

Storage racks are commonly used in warehouses and other storage facilities for supporting merchandise, boxes or pallets which support boxes or other items. It is often desirable for a worker to be able to ascend a portion of the storage rack to be able to remove or have access to items stored on the shelves of the storage rack.

A rack is typically constructed of at least two metal vertical support elements and one or more horizontal shelves. The shelves support the items, which often comprise boxes or cartons. The vertical support elements are typically constructed of metal and generally have a plurality of regularly spaced holes which can be used for bolts or screws or other attaching means which are attached to the shelves. Examples of such storage racks can be found in U.S. Pat. Nos. 3,303,937; 4,113,110; 4,549,665; 5,463,966; and 5,713,476, for example. The position of the shelves, bolts and screws can therefore be adjusted.

Currently, workers who wish to remove items from shelves of the storage racks described above are often forced to stand on a box, fork lift, tugger or pallet jack or on the lower most shelf of the rack and reach up and attempt to grab a box or carton either by a hand or by using hook-type device. Often a person will damage merchandise on a lower shelf by stepping on the carton or merchandise, or can damage contents in the carton by scrapping or puncturing it with the hooking tool. Furthermore, the person can sometimes topple the carton onto himself or onto the floor when pulling the carton off the rack or may fall off the forklift or box he is standing on.

It would be desirable for such a warehouse worker to have a step device which could be easily inserted into and removed from a portion of a storage rack to enable the worker to more readily and safely reach items stored at various heights and lateral positions on the storage rack. It is to this object that the present invention is directed.

SUMMARY OF THE INVENTION

The present invention is a rack step tool for use, for example, in a warehouse which houses a plurality of storage racks which support equipment, merchandise, or other items which are stored on the shelves of the storage racks and from which the equipment, merchandise, or other items are periodically removed.

The rack step tool generally includes a step member which is attached to a base plate. A pair of lugs is attached to the base plate for insertion into openings in a vertical support member of the storage rack. The rack step tool can be attached to the vertical support member at various heights and can be readily disengaged therefrom. The rack step tool may further have a securing element such as a hook for insertion into another hole in the support member for further securing the rack step tool thereto.

DESCRIPTION OF THE INVENTION

Figure 1:
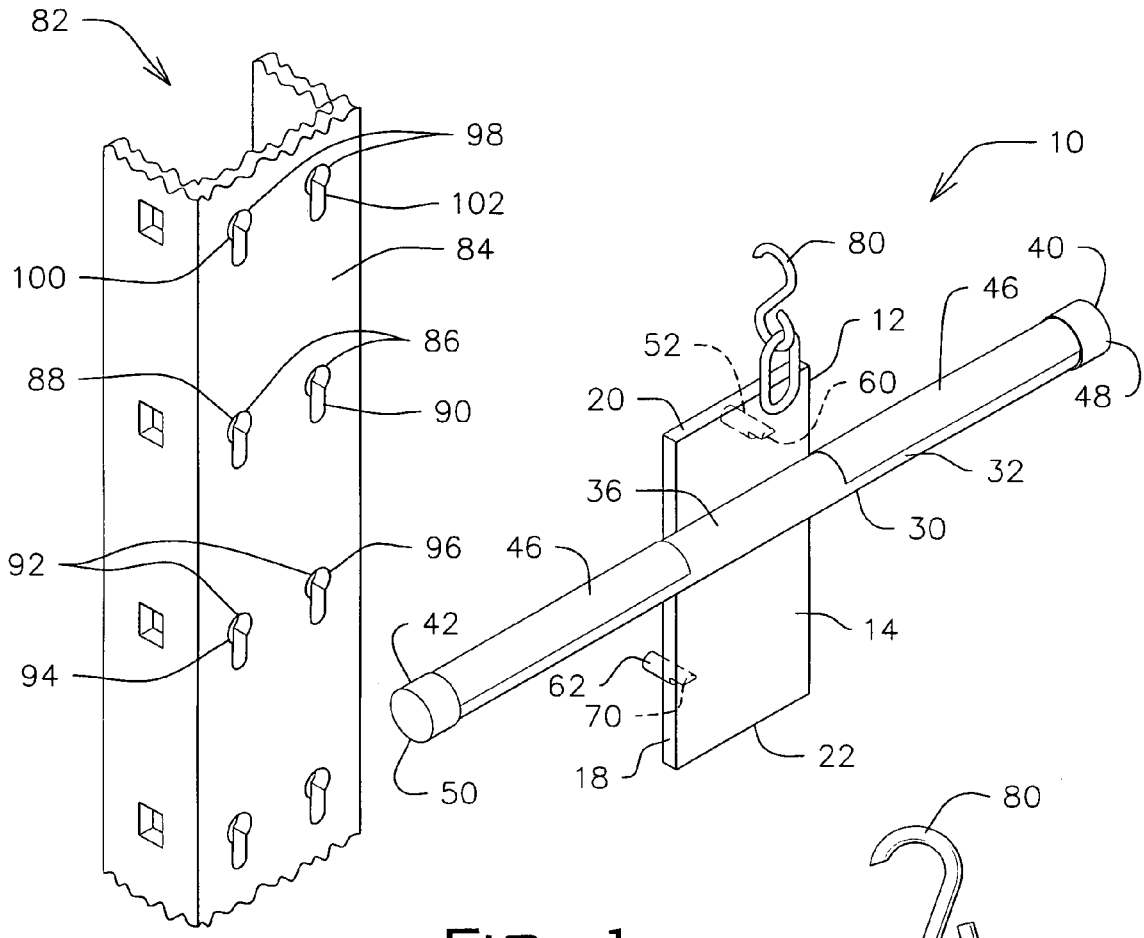
FIG. 1 is a perspective view of the rack step tool of the present invention and is shown as disposed adjacent a vertical support member of a storage rack.
Figure 2:
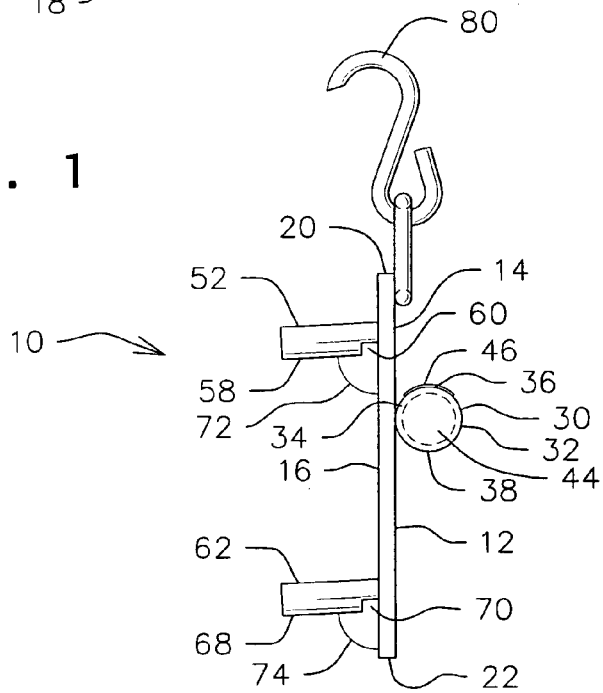
FIG. 2 is a side elevational view of the rack step tool of FIG. 1.

The present invention is a device which provides an adjustable step which can be adjustably secured to the vertical support member of a storage rack. The user can insert lugs of the device into openings of the vertical support member of the storage rack, wherein the user can then step on the device for reaching cartons or boxes placed at various locations on the shelves of the storage rack. The position of the step tool can be adjusted upwardly or downwardly on the vertical support member of the storage rack to match the particular height or need of the user.

Turning now to FIGS. 1–4, a rack step tool 10 is shown. The rack step tool 10 comprises a base plate 12 having a front surface 14, a back surface 16, an outer perimeter 18, an upper end 20 and a lower end 22. The base plate 12 is preferably constructed of metal such as steel or aluminum. The base plate 12 has a vertical axis 24 represented on the back surface 16, thereof. The vertical axis 24 separates the back surface 16 into a right side 26 and a left side 28. A step member 30 is attached to the base plate 12, generally to the front surface 14 thereof, and is preferably welded thereto or attached in any other manner known to those of ordinary skill in the art. The step member 30 is preferably constructed from a tubular metal pipe and preferably extends laterally in both directions perpendicular to the vertical axis 24 of the base plate 12. The support member 30 preferably extends 4 inches to 10 inches beyond the outer perimeter 18, and more preferably extends 6 inches to 8 inches beyond the outer perimeter 18. The step member 30 has a front surface 32, a back surface 34 to which the base plate 12 is generally attached, an upper surface 36 and a lower surface 38. The step member 30 has a first end 40 and a second end 42 and a lumen 44 therein when the step member 30 is a pipe. Preferably the step member 30 has a non-slip or anti-skid surface 46 on at least a portion of the upper surface 36. Materials for forming such anti-skid surfaces 46 are well known in the art. A first end plug 48 preferably covers the first end 40 and a second end plug 50 preferably covers the second end 42.

The rack step tool 10 further comprises a pair of lugs comprising an upper lug 52 which is attached to the base plate 12 and extends outwardly from the back surface 16 thereof and a lower lug 62 which is attached to the base plate 12 and extends outwardly from the back surface 16 thereof. The upper lug 52 and lower lug 62 preferably are offset in relation to the vertical axis 24. In particular, one of the upper lug 52 and the lower lug 62 extends from the right side 26 of the back surface 16 and the other of the upper lug 52 and the lower lug 62 extends from the left side 28 of the back surface 16. In the embodiment of FIGS. 1–4, the upper lug 52 is on the right side 26 and the lower lug 62 is on the left side 28. The offset nature of the upper lug 52 and lower lug 62 serves to help stabilize the rack step tool 10 on the storage rack during use. The upper lug 52 has a right side 54, a left side 56 and a lower side 58. Preferably, the upper lug 52 has a notch 60 therein, and in FIGS. 1–4 the notch 60 is shown as being positioned in the lower side 58 of the upper lug 52, preferably in a position directly adjacent the back surface 16 of the base plate 12. The lower lug 62 has a right side 64, a left side 66, and a lower side 68. Preferably the lower lug 62 has a notch 70 therein and in FIGS. 1–4 is shown as being in the lower side 68, preferably in a position adjacent the back surface 16 of the base plate 12.

The upper lug 52 and lower lug 62 preferably extend at least slightly downwardly from the back surface 16 of the base plate 16. Upper lug 52 extends from the back surface 16 at a first angle 72 while the lower lug extends from the back surface 16 at a second angle 74. Preferably first angle 72 and second angle 74 are 60° to 90°, more preferably from 75° to 90°, still more preferably from 85° to 90° and most preferably from 86° to 88°.

As noted above, the upper lug 52 and lower lug 62 are positioned on opposite sides of the vertical axis 24 wherein a diagonal line 76 which extends between the upper lug 52 and the lower lug 62 transects the vertical axis 24 at a transection angle 78. The transection angle is generally from about 7.5 to 75°, is more preferably from 10° to 60°, more preferably from 12.5° to 45° and most preferably from 15° to 30°.

The rack step tool of the present invention preferably further comprises a securing element 80 as shown in the rack step tool 10 of FIGS. 1–4. Preferably the securing element 80 comprises a hook or a similar mechanism for hooking into a portion of a storage rack.

The rack step tool 10, as noted above, is constructed to engage a vertical support member 82 of a standard storage rack (not shown). The vertical support member 82 as represented in FIG. 1 typically has a plurality of pairs of openings in a front surface 84 thereof. The plurality of pairs of openings may include for example a first pair of openings 86 which comprise a left opening 88 and a right opening 90, a second pair of openings 92 which comprise a left opening 94 and a right opening 96, and a third pair of openings 98, which comprises a left opening 100 and a right opening 102.

Figure 3:
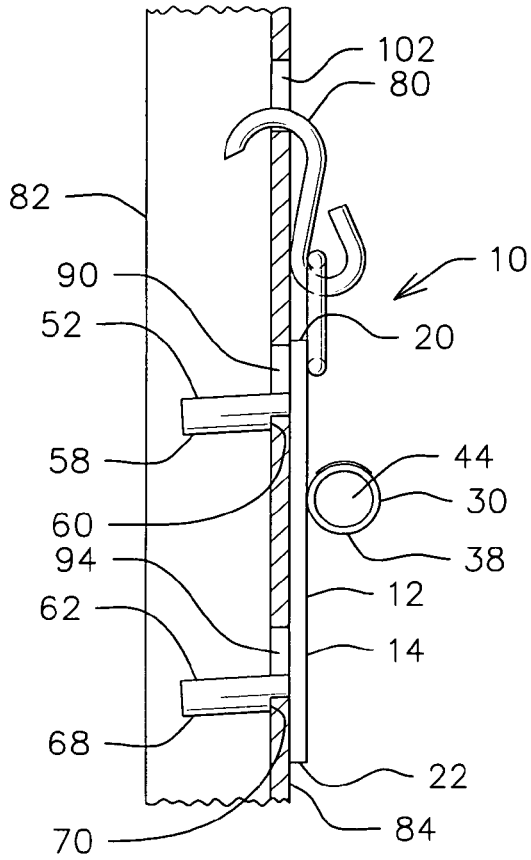
FIG. 3 is a side elevational view of the rack step tool of FIG. 1 when attached to the vertical support member of FIG. 1.

As shown in FIG. 3, the rack step tool 10, when in use, engages the vertical support member 82 of the storage rack. The upper lug 52 is inserted into the right opening 90 of the first pair of openings 86, the lower lug 62 is inserted into the left opening of the second pair of openings 92, and the securing element 80, is inserted into the right opening 102 of the third pair of openings 98 which is positioned above the right opening 90. The back surface 16 of the base plate 12 rests more or less against the front surface 84 of the vertical support member 82. The notch 60 of the upper lug 52 slides over a lower edge in the right opening 90 and the notch 70 of the lower lug 62 slides over a lower edge in the left opening 94. The user is then able to step on a left hand or right hand portion of the step member 30 to ascend or climb the storage rack to retrieve an item disposed thereon. Although the upper lug 52 and lower lug 62 are shown as being offset in a preferred embodiment, the upper lug 52 and lower lug 62 may be vertically oriented on the base plate 12 such that a line drawn between them is parallel or congruent to the vertical axis 24 of the base plate 12.

In a preferred embodiment (though the invention is explicitly not to be limited as such) the step member 30 is about 18 inches long and has a 1 inch diameter. The base plate 12 has a width of about 3 inches and a height between the upper end 20 and lower end 22 of about 6 inches. The upper lug 52 and lower lug 62 extend about 1 to 4 inches from the back surface 16. The centers of the left opening and right opening of each pair of openings in the vertical support member 82 are about 1.5 inches apart and the centers of adjacent right openings are about 4 inches apart. The rack step tool 10 is preferably constructed of a metal, but may be constructed of any suitable material such as a thermoplastic polymer or a composite resin, in all or in part.

Figure 5:
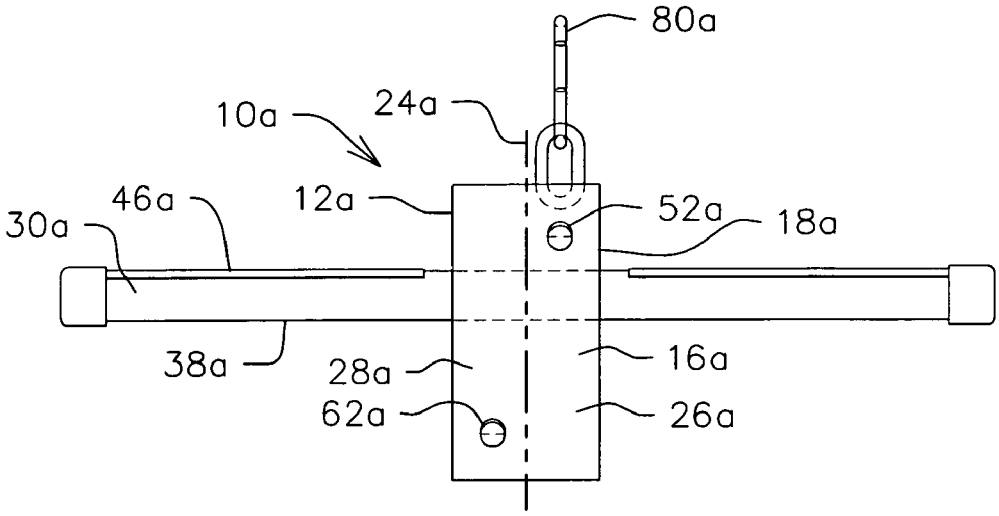
FIG. 5 is a rear elevational view of an alternate embodiment of the rack step tool of the present invention.

As noted above, the upper lug 52 of rack step tool 10 is positioned on the left side 28 of the back surface 16 while the lower lug 62 is positioned on the right side 26. In any of the embodiments of the present invention described herein, the positions of the pair of lugs may be switched. For example, shown in FIG. 5 is a rack step tool 10*a* having a base plate 12*a*, having a back surface 16*a*, an outer perimeter 18*a*, a vertical axis 24*a*, a right side 24*a*, a left side 28*a*, a step member 30*a*, an upper lug 52*a*, a lower lug 62*a* and a securing element 80*a*. The upper lug 52*a* is positioned on the right side 26*a* and the lower lug 62*a* is positioned on the left side 28*a*. The rack step tool 10*a* functions the same as rack step tool 10 in all regards.

Figure 6:
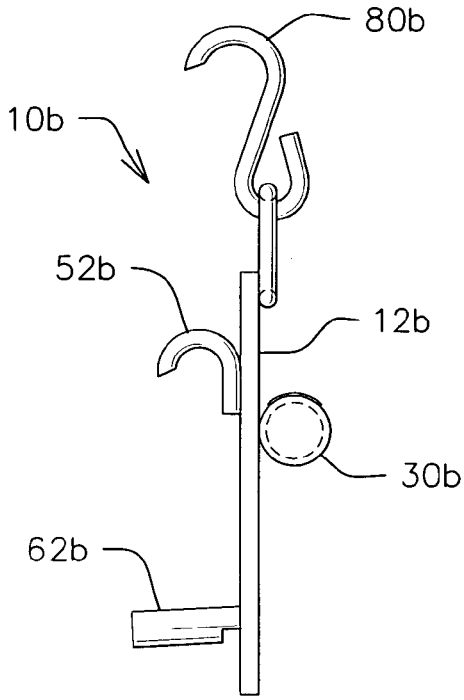
FIG. 6 is a side elevational view of an alternate embodiment of the rack step tool of the present invention.
Figure 4:
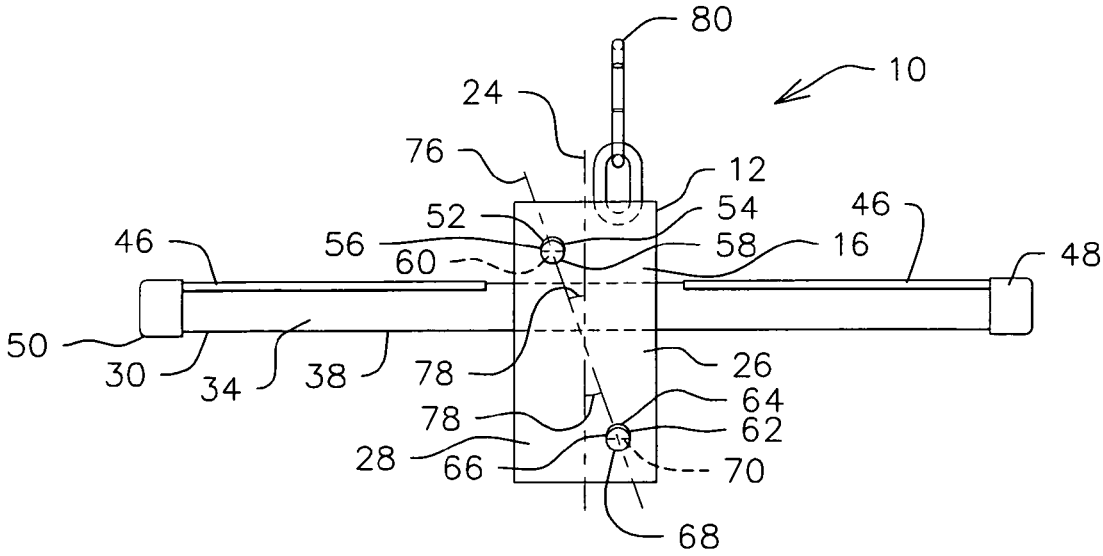
FIG. 4 is a rear elevational view of the rack step tool of FIG. 1.

Other embodiments of the present invention come readily to mind. For example, shown in FIG. 6 is a rack step tool 10*b* having a base plate 12*b*, a step member 30*b*, an upper lug

52*b*, a lower lug 62*b*, and a securing element 80*b*. Rack step tool 10*b* is the same as either of rack step tools 10 or 10*a*, or any other rack step tool embodied herein except that the upper lug 52*b* has a hook configuration, rather than a rod-like configuration, for hooking into an opening of the vertical support member 82.

Figure 7:
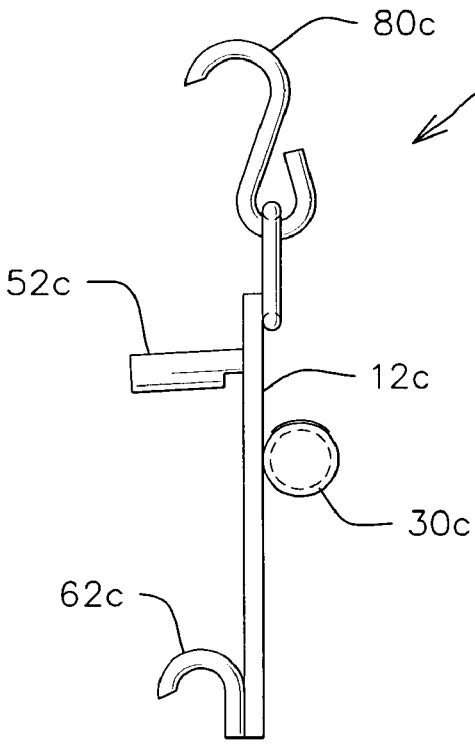
FIG. 7 is a side elevational view of an alternate embodiment of the rack step tool of the present invention.

Shown in FIG. 7 is a rack step tool 10*c* having a base plate 12*c*, a step member 30*c*, an upper lug 52*c*, a lower lug 62*c*, and a securing element 80*c*. The rack step tool 10*c* is the same as either of rack step tools 10 or 10*a*, or any other rack step tool embodied herein except that lower lug 62 has a hook configuration.

Figure 8:
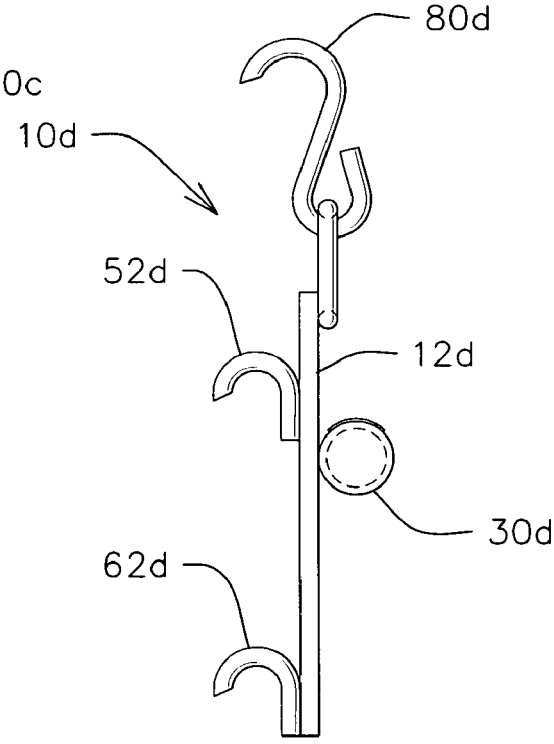
FIG. 8 is a side elevational view of an alternate embodiment of the rack step tool of the present invention.

Shown in FIG. 8 is a rack step tool 10*d* having a base plate 12*d*, a step member 30*d*, an upper lug 52*d*, a lower lug 62*d*, and a securing element 80*d*. Rack step tool 10*d* is the same as either of rack step tools 10 or 10*a*, or any other rack step tool embodied herein except that both the upper lug 52*d* and lower lug 62*d* have hook configurations rather than rod-like configurations.

Figure 9:
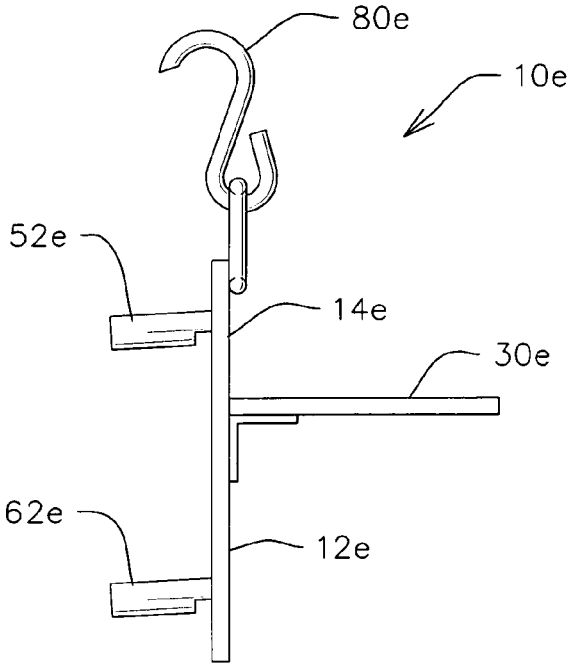
FIG. 9 is a side elevational view of an alternate embodiment of the rack step tool of the present invention.
Figure 10:
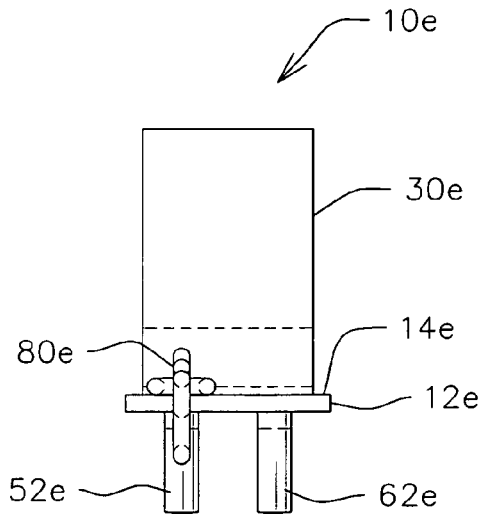
FIG. 10 is a top plan view of the rack step tool of FIG. 9.

Shown in FIGS. 9 and 10 is a rack step tool 10*e* having a base plate 12*e*, a step member 30*e*, an upper lug 52*e*, a lower lug 62*e*, and a securing element 80*e*. Rack step tool 10*e* is the same as either of rack step tools 10 or 10*a*, or any other rack step tool embodied herein except that the step member 30*e* is not a tubular pipe but rather has a flat configuration which extends perpendicularly a distance from a front surface 14*e* of the base plate 12*e*.

Figure 11:
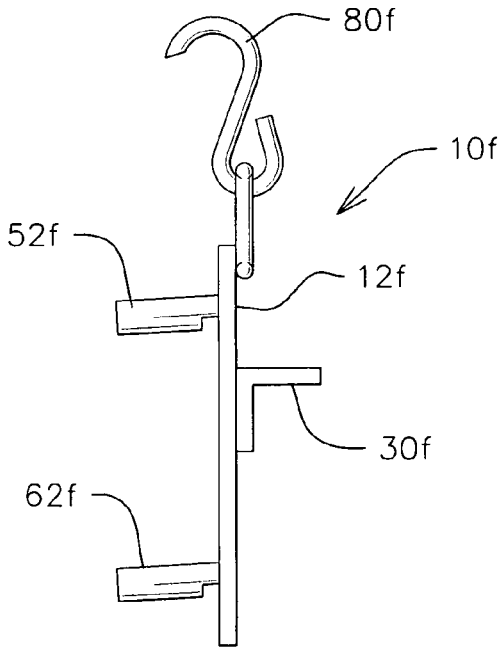
FIG. 11 is a side elevational view of an alternate embodiment of the rack step tool of the present invention.

Shown in FIG. 11 is a rack step tool 10*f* having a base plate 12*f*, a step member 30*f*, an upper lug 52*f*, a lower lug 62*f*, and a securing element 80*f*. Rack step tool 10*f* is the same as either of rack step tools 10 or 10*a*, or any other rack step tool embodied herein except that the step member 30*f* has a "V" configuration rather than a tubular configuration.

Figure 12:
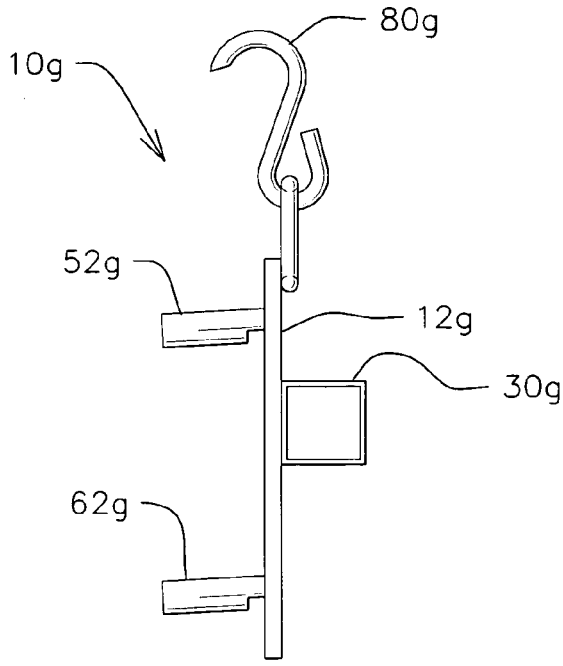
FIG. 12 is a side elevational view of an alternate embodiment of the rack step tool of the present invention.

Shown in FIG. 12 is a rack step tool 10*g* having a base plate 12*g*, a step member 30*g*, an upper lug 52*g*, a lower lug 62*g*, and a securing element 80*g*. Rack step tool log is the same as either of rack step tools 10 or 10*a*, or any other rack step tool embodied herein except that step member 30*g* is hollow and has a square cross-section.

Figure 13:
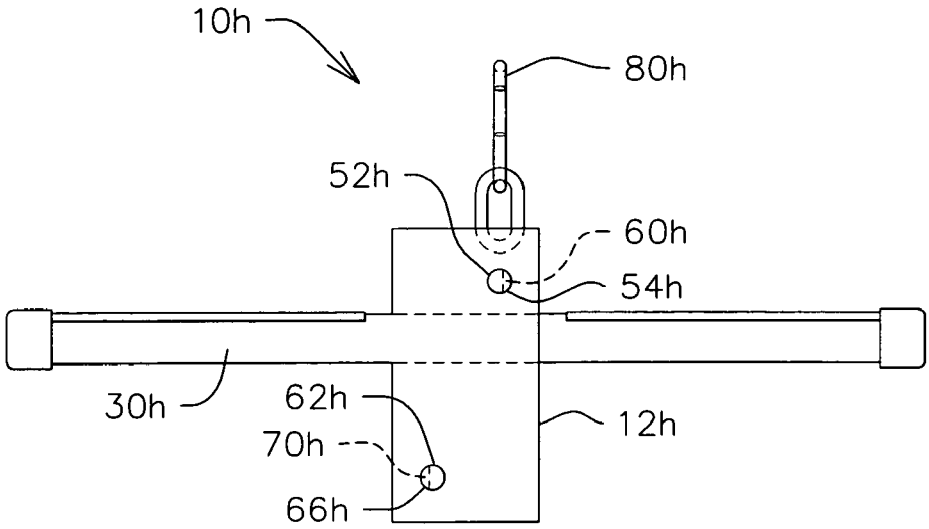
FIG. 13 is a rear elevational view of an alternate embodiment of the rack step tool of the present invention.
Figure 14:
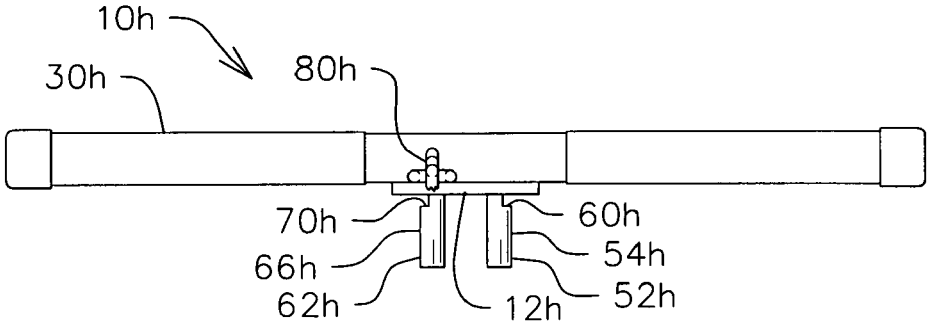
FIG. 14 is a top plan view of the rack step tool of FIG. 13.

Shown in FIGS. 13 and 14 is a rack step tool 10*h* having a base plate 12*h*, a step member 30*h*, an upper lug 52*h*, a lower lug 62*h*, and a securing element 80*h*. Rack step tool 10*h* is the same as either of rack step tools 10 or 10*a*, or any other rack step tool embodied herein except that a notch 60*h* is positioned in a right side 54*h* of upper lug 52*h* and a notch 70*h* is positioned in a left side 66*h* of lower lug 62*h*. Notch 60*h* and notch 70*h* are configured in the right side 54*h* and left side 66*h*, respectively, for engaging a tapered lower edge of "keyhole"-shaped openings in a typical vertical support element 82 of a storage rack, for example such as those seen in U.S. Pat. No. 3,303,937.

Figure 15:
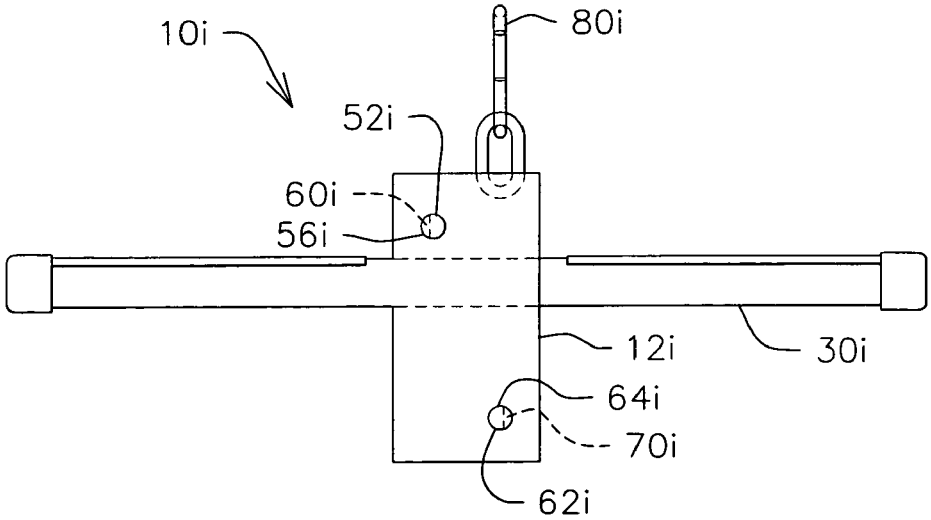
FIG. 15 is a rear elevational view of an alternate embodiment of the rack step tool of the present invention.

Shown in FIG. 15 is a rack step tool 10*i* having a base plate 12*i*, a step member 30*i*, an upper lug 52*i*, a lower lug 62*i*, and a securing element 80*i*. Rack step tool 10*i* is the same as either of rack step tools 10 or 10*a*, or any other rack step tool embodied herein except that a notch 60*i* is positioned in a left side 56*i* of upper lug 52*i* and a notch 70*i* is positioned in a right side 64*i* of lower lug 62*i*. Notch 60*i* and notch 70*i* are configured in the left side 56*i* and right side 64*i*, respectively, for engaging a lower edge of "keyhole"-shaped openings in a typical vertical support element 82 of a storage rack as noted above.

Any of the rack step tools 10–10*i* may have additional notches in the lower side or left or right sides thereof for additional effectiveness in engaging to a lower edge of an opening of the vertical support element 82.

Figure 16:
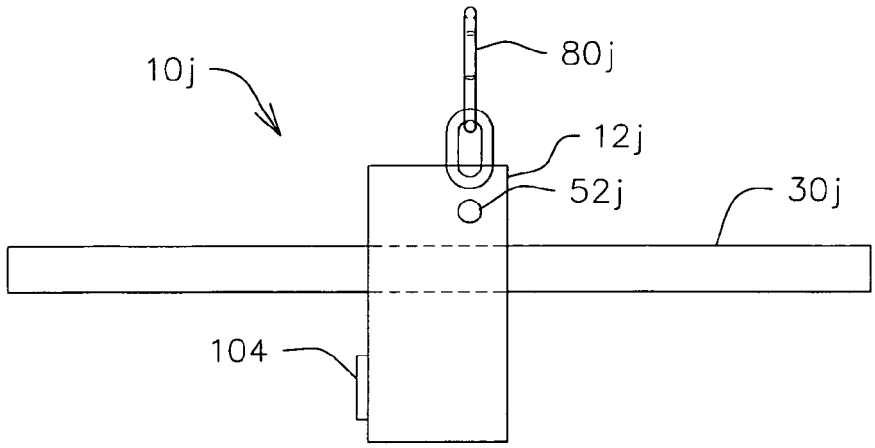
FIG. 16 is a rear elevational view of an alternate embodiment of the rack step tool of the present invention.
Figure 17:
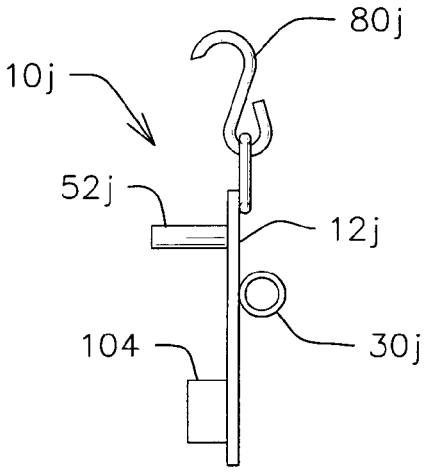
FIG. 17 is a side elevational view of the rack step tool of FIG. 16.

Shown in FIGS. 16 and 17 is a rack step tool 10*j* having a base plate 12*j*, a step member 30*j*, an upper lug 52*j*, a lower lug 104*j*, and a securing element 80*j*. Rack step tool 10*j* is the same as either of rack step tools 10 or 10*a*, or any other rack step tool embodied herein except that the lower lug 104 is a flange, rather than a rod or hook, and is attached to and extends from or near to a lower edge of the base plate 12*j*. The lower lug 104 preferably sits astride an outer edge of the vertical support element 82 rather than inside an opening thereof when the rack step tool 10*j* is secured to the vertical support element 82.

Figure 18:
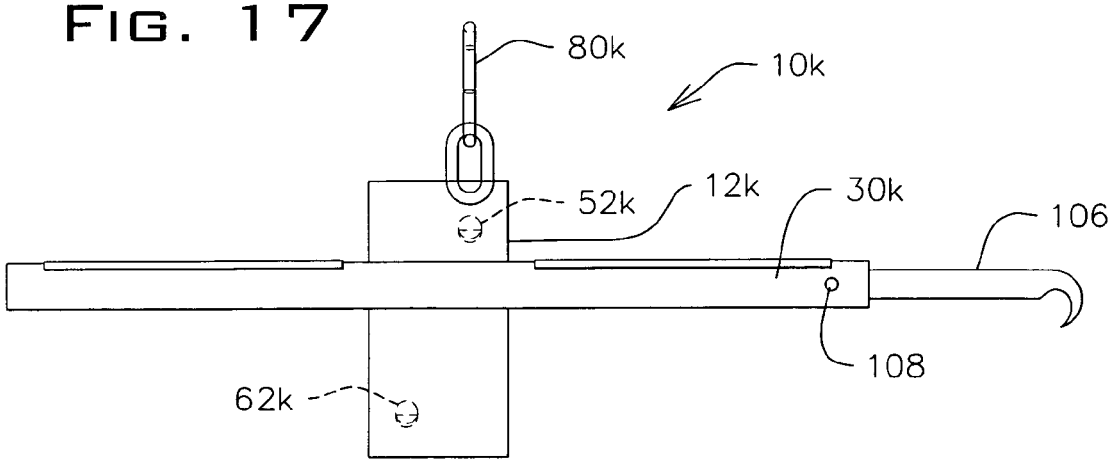
FIG. 18 is a front elevational view of an alternate embodiment of the rack step tool of the present invention.

Shown in FIG. 18 is a rack step tool 10*k* having a base plate 12*k*, a step member 30*k*, an upper lug 52*k*, a lower lug 62*k*, and a securing element 80*k*. Rack step tool 10*k* is the same as either of rack step tools 10 or 10*a*, or any other rack step tool embodied herein except that rack step tool 10*k* has a hook extension 106 which can telescopically extend from and back into the step member 30*k*. Preferably the hook extension 106 can be locked into place via a locking device 108 in the step member 30*k*. The hook extension 106 can be used by a user of the rack step tool 10*k* to hook and retrieve boxes or items on the storage rack.

Figure 19:
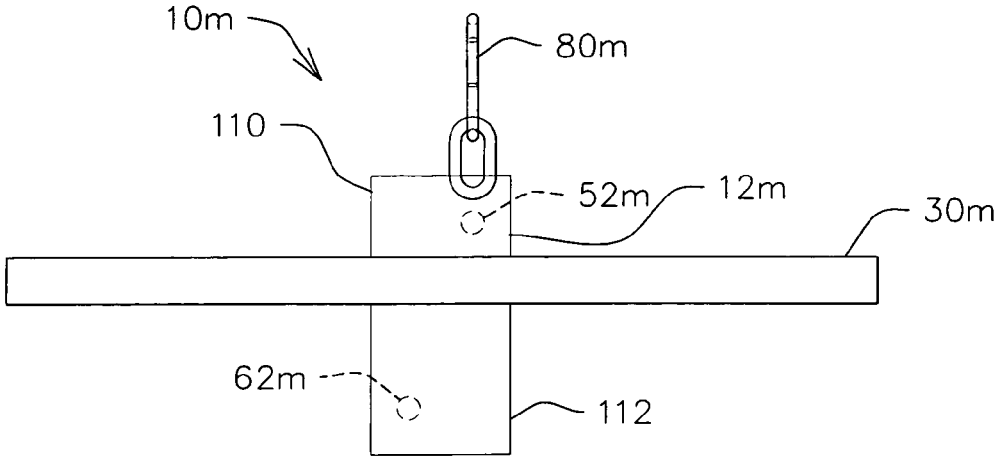
FIG. 19 is a front elevational view of an alternate embodiment of the rack step tool of the present invention.
Figure 20:
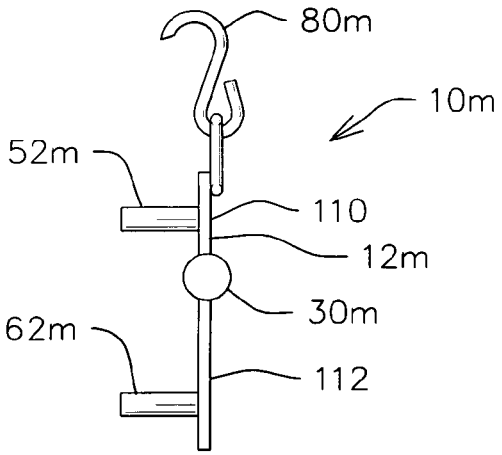
FIG. 20 is a side elevational view of the rack step tool of FIG. 19.

Shown in FIGS. 19 and 20 is a rack step tool 10*m* having a base plate 12*m*, a step member 30*m*, an upper lug 52*m*, a lower lug 62*m*, and a securing element 80*m*. Rack step tool 10*m* is the same as either of rack step tools 10 or 10*a*, or any other rack step tool embodied herein except that the base plate 12*m* is constructed of an upper portion 110 and a lower portion 112. The upper portion 110 is connected to and extends from an upper portion of the step member 30*m* and the lower portion 112 is connected to and extends from a lower portion of the step member 30*m*. It will be understood by a person of ordinary skill in the art that the step member 30 in any embodiment herein may be constructed to the base plate at an upper, middle, or lower portion thereof.

Figure 21:
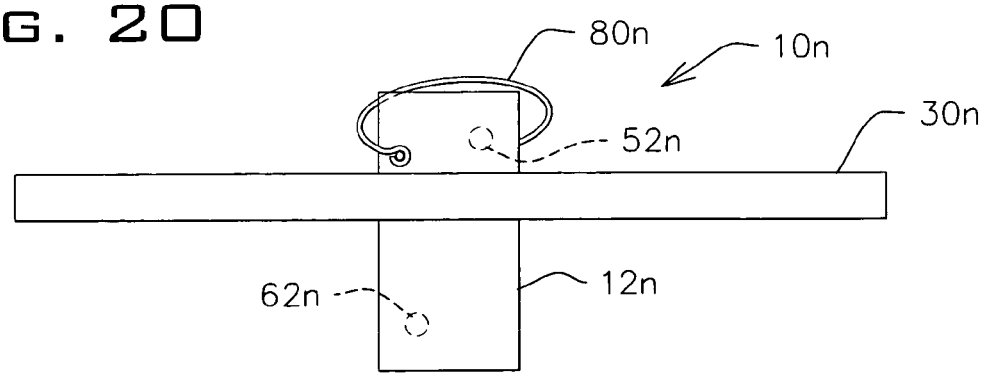
FIG. 21 is a front elevational view of an alternate embodiment of the rack step tool of the present invention.

Shown in FIG. 21 is a rack step tool 10*n* having a base plate 12*n*, a step member 30*n*, an upper lug 52*n*, a lower lug 62*n*, and a securing element 80*n*. Rack step tool 10*n* is the same as either of rack step tools 10 or 10*a*, or any other rack step tool embodied herein except that the securing element 80*n* is a chain, wire or other tying mechanism which is designed to loop around a back of the vertical support member 82 and reattach to a portion of the base plate 12*n* thereby securing the base plate 12*n* to the vertical support member 82.

Figure 22:
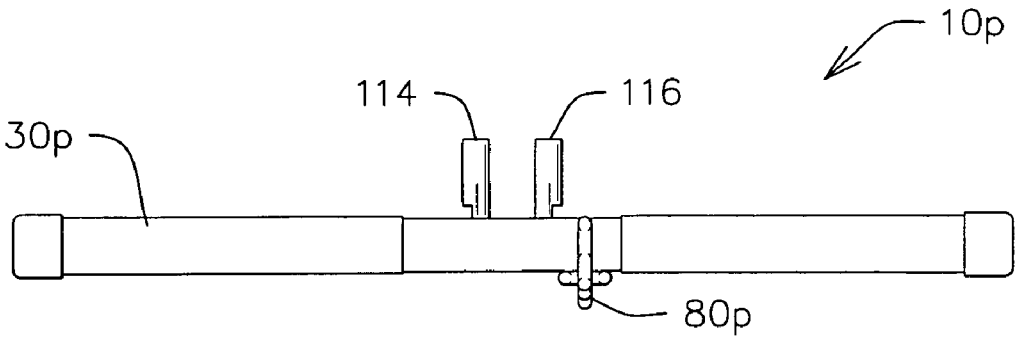
FIG. 22 is a top plan view of an alternate embodiment of the rack step tool of the present invention.
Figure 23:
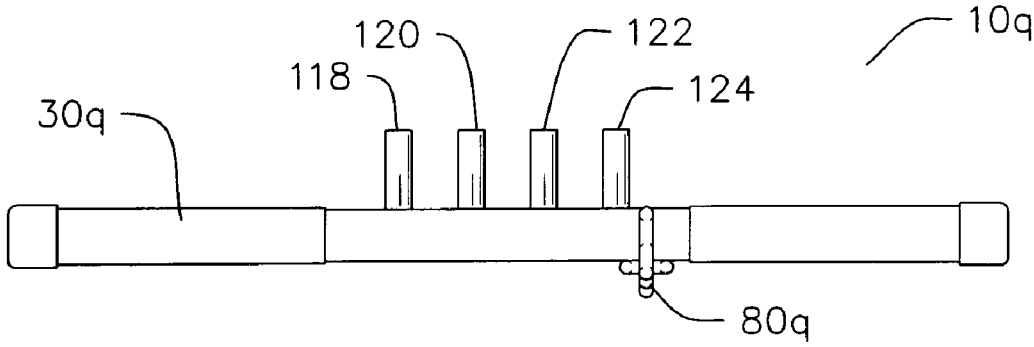
FIG. 23 is a top plan view of an alternate embodiment of the rack step tool of the present invention.

Shown in FIG. 22 is an alternate embodiment of the present invention. Rack step tool 10*p* has a step member 30*p*, a securing element 80*p*, and a pair of lugs 114 and 116 which are attached directly to the step member 30*p*. Shown in FIG. 23 is another embodiment of the invention and is similar to rack step tool 10*p*. Rack step tool 10*q* of FIG. 23 has a step member 30*q*, a securing element 80*q*, and four lugs, 118, 120, 122, and 124, which are designed to fit into four parallel openings in a vertical support member having openings in such a configuration.

Figure 24:
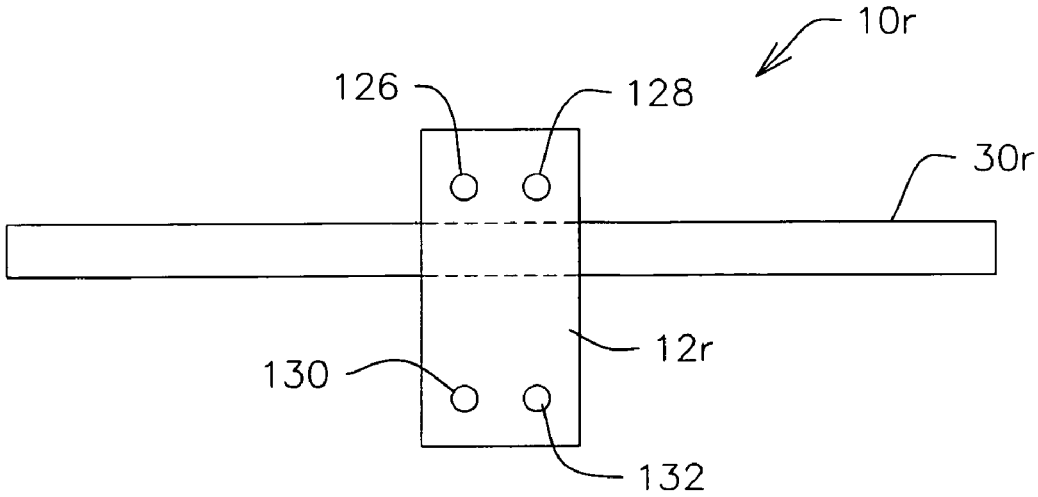
FIG. 24 is a front elevational view of an alternate embodiment of the rack step tool of the present invention.

Shown in FIG. 24 is a rack step tool referred to by the general reference numeral 10*r* which is similar to the other embodiments herein in having a base plate 12*r* and a step member 30 except the rack step tool 10*r* has two pairs of lugs, including an upper pair comprising a left upper lug 126 and a right upper lug 128, and a lower pair comprising a left lower lug 130 and a right lower lug 132. Rack step tool 10*r* functions in a manner similar to rack step tool 10 or any other rack step tool embodiment herein, except when rack step tool 10*r* is engaged with the vertical support member 82, left upper lug 126 and right upper lug 128 fit into openings 90 and 88, and left lower lug 130 and right lower lug 132 fit into openings 96 and 94 of the vertical support element 82.

The present invention comprises not only devices such as rack step tools 10–10*r* described herein, and variations thereof, but also includes methods of using the tool in conjunction with a storage rack and includes the rack step tool 10–10*r* in combination with a storage rack or any portion thereof to which the tool may be attached.

When the rack step tool 10–10*r* is being attached to the vertical support member 82 of the storage rack, the rack step tool 10–10*r* is not twisted or rotated more than a few degrees to be secured to the vertical support member 82, and then only to be snugly seated in the openings of the vertical support member 82. The step member 30–30*r* of the rack step tool 10–10*r* extends perpendicularly from the vertical support member 82 either from the front surface of the vertical support member 82 or from a side edge thereof.

Changes may be made in the construction and the operation of the various components, elements and assemblies described herein or in the steps or the sequence of steps of the methods described herein without departing from the spirit and scope of the invention as defined in the following claims.

What is claimed is:

1. A rack step tool, comprising:

a single base plate having a front surface, a back surface and an outer perimeter, the single base plate having a vertical axis which divides the back surface into a left side and a right side;

an elongated step member attached to the front surface of the base plate and extending laterally, outwardly from the outer perimeter on both sides of the base plate and substantially forming a T-shape with the base plate and the step member having an anti-skid surface disposed on the upper surface thereof; and means for insertion into openings in a vertical support member of a storage rack consisting of a single pair of lugs comprising an upper lug and a lower lug, wherein one of the upper lug and lower lug is attached to the single base plate and extends from the right side of the back surface of the single base plate and the other of the upper lug and lower lug is attached to the single base plate and extends from the left side of the back surface of the single base plate, and wherein the upper lug and lower lug are on opposite sides of the vertical axis such that a diagonal line extending between the upper lug and the lower lug transects the vertical axis of the single base plate at a transection angle.

2. The rack step tool of claim 1 wherein at least one of the upper lug and the lower lug is a rod.

3. The rack step tool of claim 1 wherein the upper lug is a rod and the lower lug is a rod.

4. The rack step tool of claim 1 comprising a first angle between the upper lug and the back surface and a second angle between the lower lug and the back surface, wherein the first angle and second angle are each from 60° to 90°.

5. The rack step tool of claim 1 comprising a first angle between the upper lug and the back surface and a second angle between the lower lug and the back surface, wherein the first angle and second angle are each from 75° to 90°.

6. The rack step tool of claim 1 comprising a first angle between the upper lug and the back surface and a second angle between the lower lug and the back surface, wherein the first angle and the second angle are each from 85° to 90°.

7. The rack step tool of claim 1 wherein the transection angle is 15° to 30°.

8. The rack step tool of claim 1 further comprising a securing element attached to and extending from an upper portion of the single base plate.

9. The rack step tool of claim 1 wherein the pair of lugs are adapted to fit into at least two openings of the vertical support member of the storage rack.

* * * * *